US006541720B2

(12) United States Patent
Gerald et al.

(10) Patent No.: US 6,541,720 B2
(45) Date of Patent: Apr. 1, 2003

(54) ELECTRICAL CONNECTING DEVICE FOR CONTACTING CONDUCTOR WIRES

(75) Inventors: Ladstätter Gerald, Dornbirn (AT); Gadner Wolfgang, Hörbranz (AT)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 09/893,641

(22) Filed: Jun. 29, 2001

(65) Prior Publication Data

US 2001/0045347 A1 Nov. 29, 2001

Related U.S. Application Data

(63) Continuation of application No. PCT/EP99/10398, filed on Dec. 27, 1999.

(30) Foreign Application Priority Data

Dec. 30, 1998 (DE) ..... 298 23 256
Dec. 30, 1998 (DE) ..... 298 23 255

(51) Int. Cl.[7] ..... H01R 9/03

(52) U.S. Cl. ..... 200/51.05; 200/51.03; 362/221; 439/211

(58) Field of Search ..... 439/211, 207–9, 439/212–3; 200/51.02–6; 362/221, 219, 225

(56) References Cited

U.S. PATENT DOCUMENTS 4,666,223 A * 5/1987 Tillmann ..... 200/51.06
4,781,609 A * 11/1988 Wilson et al. ..... 439/210 X
5,045,981 A * 9/1991 Nagano ..... 362/219
5,177,404 A * 1/1993 Cohen et al. ..... 362/221 X
5,967,818 A * 10/1999 Carron et al. ..... 439/211

FOREIGN PATENT DOCUMENTS

| | | | |
|---|---|---|---|
| DE | 196 15 597 A | 10/1997 | |
| DE | 196 15 600 A | 10/1997 | |
| DE | 297 09 127 U | 11/1998 | |
| GB | 2218578 * | 11/1989 | ..... 439/211 |

* cited by examiner

*Primary Examiner*—Renee Luebke
(74) *Attorney, Agent, or Firm*—Fitzpatrick, Cella, Harper & Scinto

(57) ABSTRACT

The invention relates to an electrical connection device for contacting conductor wires of a plurality of electrical conductors (12), running in a strip-like manner, of a conductor wire combination, with the conductor wires of electrical connection lines of an electrical consuming unit, in particular a light of a lighting strip system, whereby the connection device (13) has a coupling part to (13*a*) and a counter-coupling element (13*b*) having contact elements (16) which upon plugging together of the counter-coupling element (13*b*) with the coupling parts (13*a*) each make a current connection to associated conductor wires, whereby the contact elements (16) are arranged in two rows (R1, R2) extending transversely to the conductor wires and there is associated with one row (R1) a contact position selection device (25*a*) for displacing at least one contact element (16) between at least two neighbouring contact positions. For the purpose of improving the adaptability of the connection device to different functions and/or current supplies and/or installation situations, there is also displaceably arranged in the second row (R2) a contact position selection device (25*b*) for moving at least one of the contact elements (16) arranged in this second row (R2) between two contact positions neighbouring one another.

11 Claims, 5 Drawing Sheets

ELECTRICAL CONNECTING DEVICE FOR CONTACTING CONDUCTOR WIRES

REFERENCE TO RELATED APPLICATIONS

This is a Continuation of copending International Application No. PCT/EP99/10398, filed Dec. 27, 1999 and published in German, but not in English, on Jul. 13, 2000, the priority of which is claimed.

BACKGROUND OF THE INVENTION

1. Field of the Invention

The invention relates to an electrical connecting device for connecting a plurality of electrical conductors with conductor wires of electrical systems.

2. Description of the Related Art

An electrical connecting device of this kind is described in 196 15 597 A1. With this known connecting device there is provided a conductor wire combination in the form of a through-wiring having five conductor wires, in particular as a flat ribbon, which is located in a carrier rail of a lighting strip system. Thereby, in each case one light is electrically connectable with the conductor wire combination by means of two connecting devices. The contacts of the connecting devices are located in each case in two rows extending transversely to the longitudinal direction of the conductor wires, whereby in the one row there are located three phase contacts and in the other row an earthing contact and a neutral line contact. In the contact row in which the phase contacts are located there is arranged on the associated counter-coupling element a phase selection device which makes it possible selectively to contact one of the three available phases. By this means it is possible to distribute the plurality of lights of the lighting strip system over three phases. It is thus possible so to set lights having per se like counter-coupling elements that different phases are contacted and thus an overloading of a phase is avoided.

With modern electrical current supply devices, such as e.g. a lighting strip system, there is requirement for a particular adaptability, e.g. for the purpose of adaptation to at least one current supply network and/or control current supply network.

SUMMARY OF THE INVENTION

It is an object of this invention to provide a novel and improved connecting device for connecting conductor wires which run in a strip, to electrical connection lines of an electrical consuming unit, in a manner which permits adaptability to various functions, current supplies and/or installation situations.

The novel connecting device of this invention comprises a coupling part and a counter-coupling element, each having contact elements which, upon plugging together of the coupling and counter-coupling parts, electrically connect the connection lines to selected ones of the conductor wires. The connection lines of the electrical consuming unit run in a direction which is transverse to the direction of the conductor wires in the strip.

The counter-coupling part has first and second contact position selection devices which are moveable, respectively, in first and second rows which extend transversely to the strip; and each of the first and second contact position selection devices is configured to permit displacement of at least one associated contact element between at least two contact positions in its associated row.

A connection device in accordance with the invention has in both contact rows a contact selection device. Thereby, the selection devices can in each case relate to a plurality of or all of the contacts arranged in the associated row. That is, in each contact row the connecting device can be so set that selection can be made between two or between more or between all contacts. By these means the goal is achieved of improving the adaptability of the connecting device.

Thereby it is advantageous in particular for safety reasons and for the purpose of simplification to arrange an associated earthing contact non-adjustably. By these means the likelihood is reduced that earthing is interrupted through an adjustment of the earthing contact.

It is for example possible within the scope of the invention to contact different current networks with the connecting device, e.g. a current supply network and/or an emergency current supply network and/or a control current network. Thereby it is further advantageous when a plurality of current networks are provided, e.g. two emergency current supply networks, which can be contacted with the one or the other selection device. By these means it is possible to distribute associated lights over the plurality of current networks, e.g. two emergency current supply networks, so that an overloading of one current network is avoided.

Additional features are described and claimed herein which lead to compact and simple constructions which can be advantageously integrated into a connection device, and which beyond this ensure an economical configuration and a good functioning, which inter alia make possible also simple adjustment and setting of the connection device.

BRIEF DESCRIPTION OF THE DRAWINGS

Below, the invention and further advantages which can be achieved thereby will be described in more detail with reference to simplified drawings and advantageous embodiments.

DETAILED DESCRIPTION OF THE PREFERRED EMBODIMENTS

Figure 1:
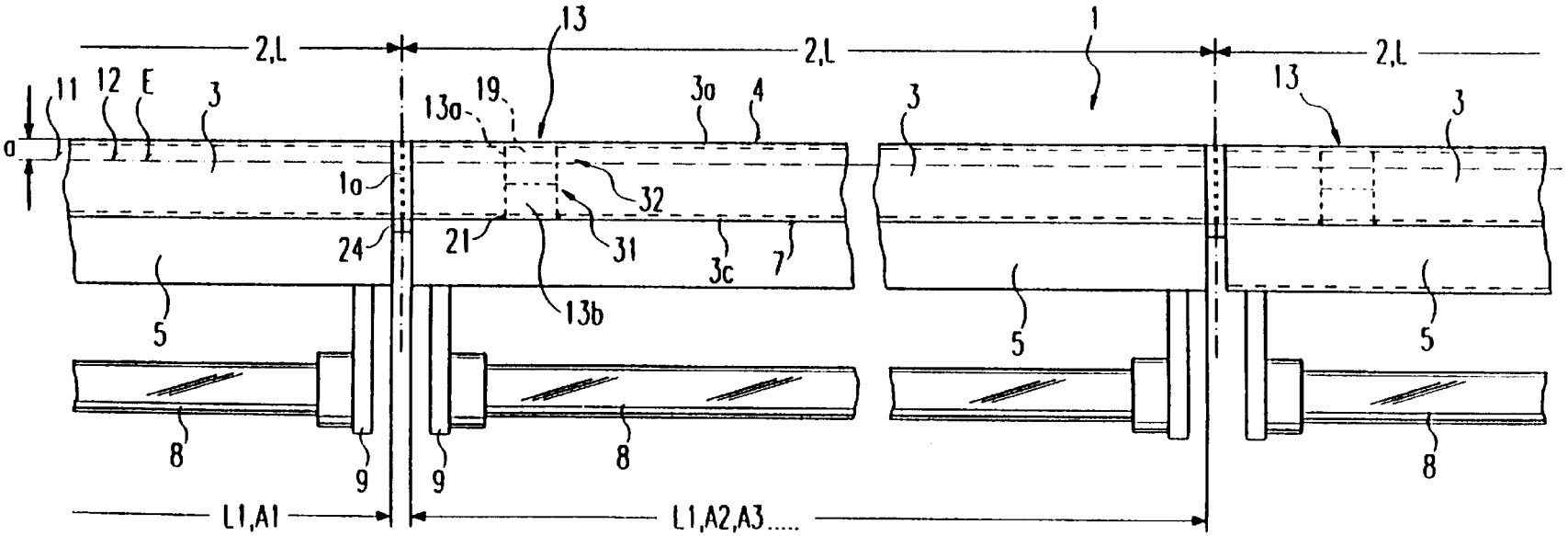
FIG. 1 is a side view showing a plurality of lighting strip sections, in accordance with the invention, of a lighting strip system, in each case with a carrier rail, connection parts and a plurality of lights applied thereto.

Of the lighting strip designated by 1 in FIG. 1 there is illustrated only a longitudinal section of the associated lighting strip system, which consists of a plurality of lighting strip sections 2 or modules arranged in a row one after another. The lengths L of these sections or modules are preferably the same but in principle may differ, for example being determined by a transportable length of e.g. about 4 m to 6 m. Schematically illustrated joints between adjacent lighting strip sections 2 are designated by reference characters 1*a*. Since the lighting strip sections 2 are identically formed, only one lighting strip section 2 will be described herein.

Figure 2:
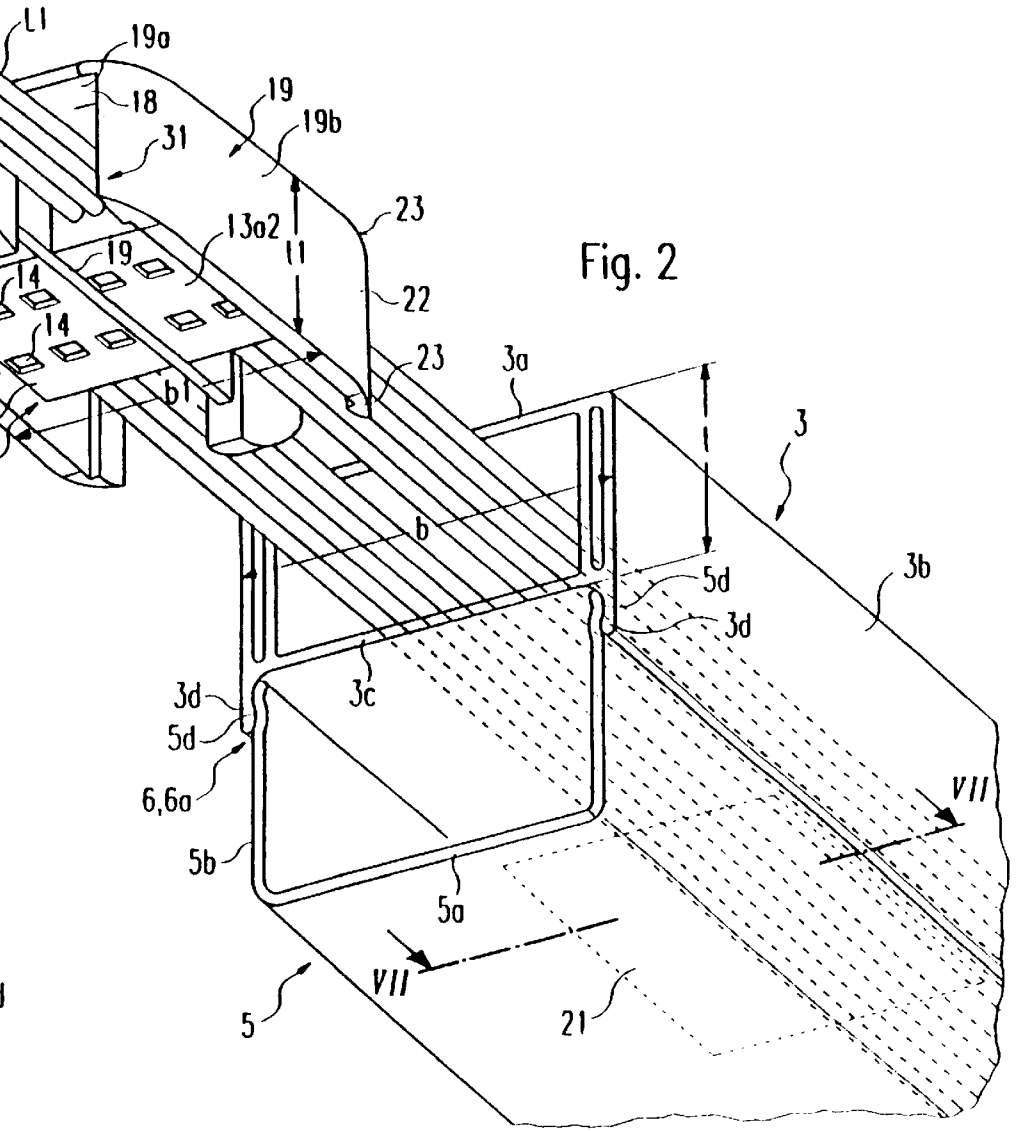
FIG. 2 is an exploded perspective view, showing a lighting strip section and a first plug-in connection part according to a first exemplary embodiment.
Figure 3:
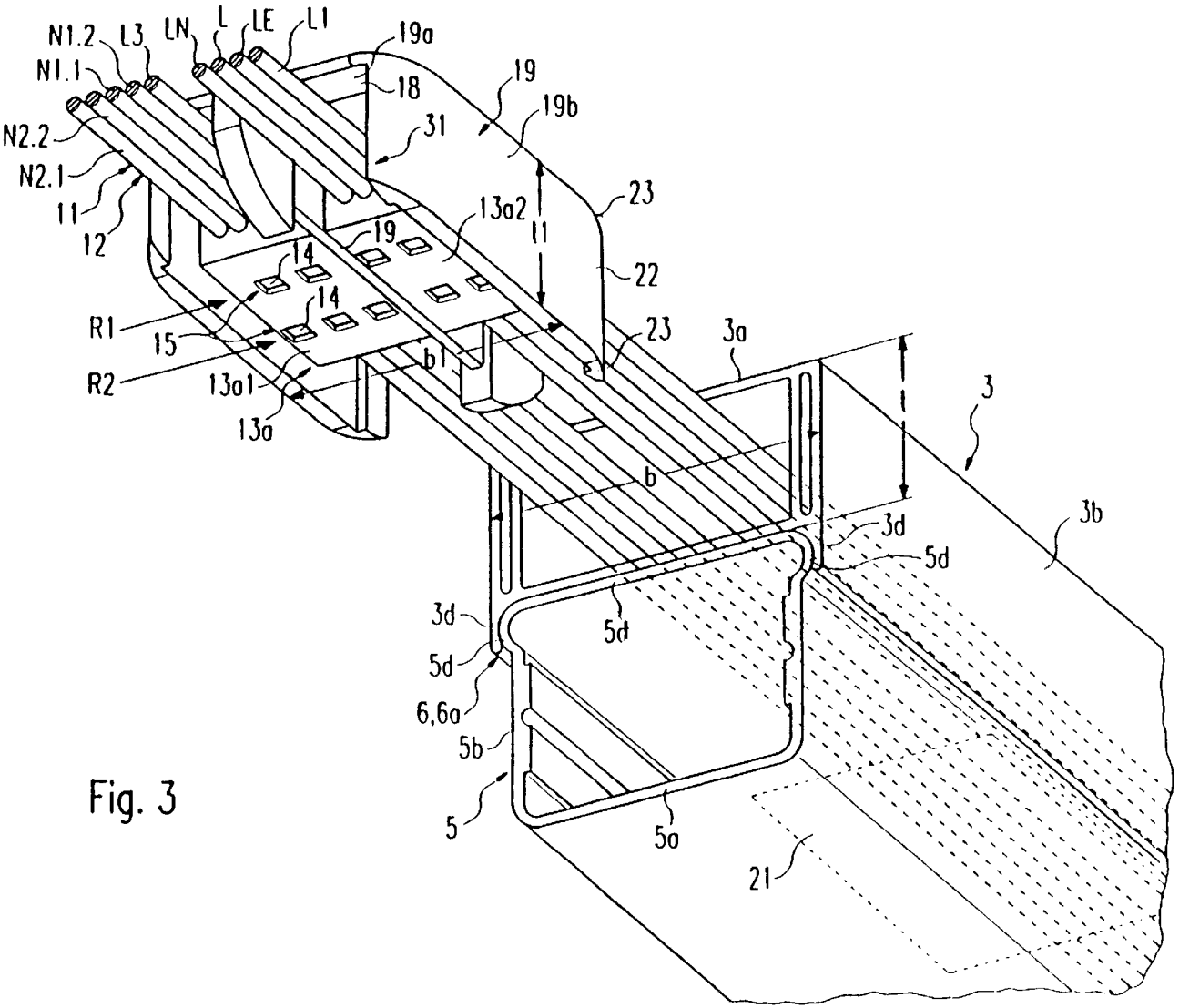
FIG. 3 is a view similar to FIG. 2 but showing a lighting strip section in accordance with a second exemplary embodiment.

The main parts of the lighting strip section 2 are a carrier rail 3 of tube-like or U-shaped cross-section. The carrier rail has a base side 4, shown in FIG. 1 at the top thereof, with which the carrier rail 3 can be attached to a carrier (not shown), e.g. a room ceiling or a room wall, by means of non-illustrated first fastening means, e.g. screws. A plurality of similar lights A1, A2, A3, etc. are arranged one after another in the longitudinal direction of the lighting strip 1, in each case together with a tube-shaped light body 5. The tube-shaped bodies are each releasably connectable with a connection side 7 of the carrier rail 3 which is located away from the base side 4. The releasable connection is made by means of non-illustrated second fastening means, e.g. a quick-fastening connection 6 or a latching device 6*a*, as shown in FIGS. 2 and 3. One or more lamps 8 are arranged in parallel with each other in, or with the present exemplary embodiment, on the light body 5. The lamps, which may be gas discharge tubes, are held by means of mountings on mounting bodies 9 on the light body 5 and by means of which the length L1 of the light rebodies 5 is determined.

A through-wiring 11 having a plurality of wires 12, preferably nine, extends longitudinally through the carrier rail 3. These wires are arranged in a plane E extending parallel to a base wall 3*a* of the carrier rail and at a spacing a from the base wall 3*a*. The wiring may be formed by one or two so-called flat conductor ribbons, the individual wires of which are held together by means of a ribbon extending longitudinally of the plane E.

A plurality of plug-in connections 13, each for a light A1, A2, A3, etc., are preferably arranged off center, as viewed transversely of the longitudinal direction of the lighting strip 1. Each plug-in connection has a plug-in connection part 13*a* preferably in the form of a socket. The plug-in connection part 13*a* is arranged in the carrier rail 3 at the end face thereof towards the light body 5. As shown in FIG. 2, the plug-in connection part 13*a* has plug openings 14 of the same number as that of the wires 12. Also, as schematically illustrated in FIG. 2, contact elements 15 are arranged within the openings 14 which are located in a chamber.

Figure 4:
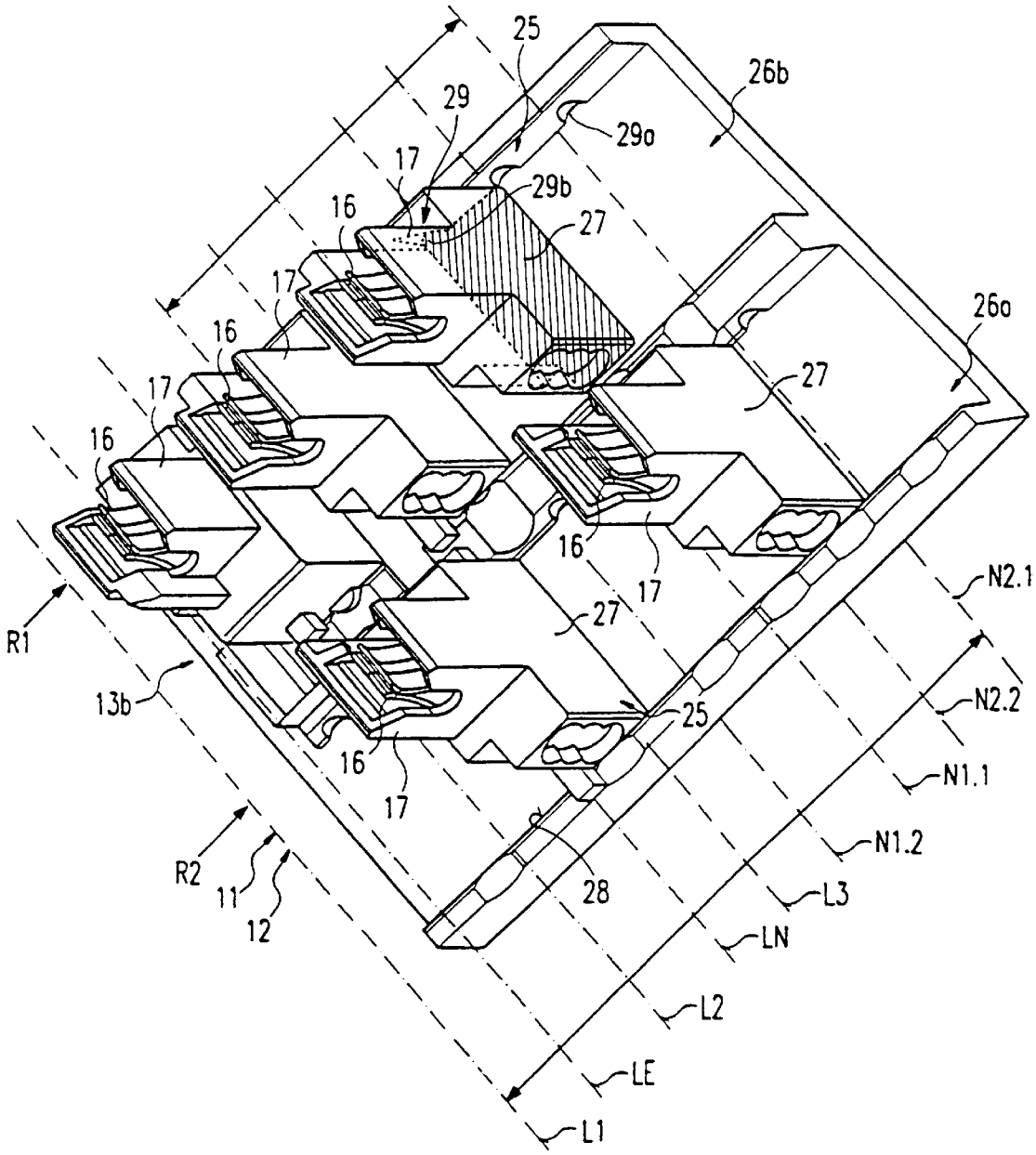
FIG. 4 is a perspective view showing a second plug-in connection part used in the lighting strip section of FIG. 1.

A second plug-in connection part 13*b* (FIG. 1), corresponding to the first plug-in connection part 13*a*, which is preferably in the form of a plug, is arranged on the light body 5 in opposition to the plug-in connection part 13*a*. As shown in FIG. 4, the second plug-in connection part 13*b* has counter plug-in contact elements 16 each in opposition to the plug openings 14 of the first connection part 13*a*. The contact elements 16 are arranged in one or two rows R1, R2, which extend transverse to the wires 12. Each contact element 16 can be contacted with a respective associated contact element 15 in the plug-in connection part 13*a*.

As can also be seen in FIG. 4, in the present configuration, the plug contact elements 16 of the second plug-in connection part 13*b* are each located in a plug shaft 17. The cross-sectional shape and size of the shaft 17 corresponds to the cross-sectional shape and size of the plug openings 14 of the first plug-in connection part 13*a* so that it can be plugged therein with slight play for movement. This provides a guiding directed transversely to the longitudinal direction of the lighting strip 1.

The carrier rail 3 is a profile section which can be manufactured by extrusion or, in the case of a U-shaped cross-section, can be manufactured by bending.

The number of light bodies 5 which are arranged one after another along the length of the lighting strip section 2 is determined by the length L1 of the lighting bodies 5. This in turn is determined by means of conventional standardized dimensions of the elongate lamps 8, which as shown may be gas discharge tubes. The mounting bodies 9 (FIG. 1) are arranged at the ends of the light bodies 5 whereby in each case they stand out from the respective light body 5 on the connection side thereof away from the carrier rail 3. The lamps 8 may each be covered by means of a protective sleeve, which is not shown for reasons of simplification.

With the exemplary embodiment according to FIGS. 2 and 3 the first plug-in connection parts 13*a* are in each case formed by means of two plug-in connection parts 13*a*1, 13*a*2 in the shape of plug-in sleeves. These sleeves, which form plug-coupling parts, are arranged transversely next to one another in a chamber 18 of a slide 19 and are held by means of non-illustrated latching devices. With the present configuration, the slide 19 has, in cross-section, a U-shape having a slide floor wall 19*a* towards the base side 4 (FIG. 1) and slide side walls 19*b*, extending in a longitudinal direction. One or both plug-in connection parts 13*a*, 13*a*1, 13*a*2 are arranged transversely adjacent one another between the slide side walls 19*b*; and the connector parts may be separated from one another by a longitudinally extending middle wall 19*c* of the slide 19. In a comparable manner the second plug-in connection part 13*b* (FIG. 4) which is associated with the respective lights A1, A2, A3, etc. (FIG. 1) can be formed by means of two plug-in connection parts or plugs lying transversely adjacent one another.

The plug-in sleeves 13*a*1, 13*a*2 (FIG. 2) and the associated plug-in connection part 13*b* (FIG. 4) have plug-in contact elements which in each case, form plug-in couplings and plug-in counter-couplings for the direct or indirect electrical connection of the plug-in contact elements 16 (FIG. 4) with the associated wires 12 (FIG. 2). Within the scope of the invention, the plug-in contact elements 16 may cooperate with the contact elements 15 allocated to the associated plug-in connection part 13*a*, or the plug-in contact elements 16 may stand in direct contact with the associated wires 12. In such case there may be involved the usual clamping contact elements or cutting/clamping contact elements, whereby the latter can cut into and contact insulated electrical wires 12. The mountings in each case are connected by means of conventional electrical conductors with the associated plug-in connection part 13*b*.

The carrier rail 3 may have a U-shape in cross-section, whereby its side walls 3*b* form the limbs of the U-shape and its cover wall 3*c* forms a web wall of the U-shape. Alternatively, the carrier rail 3 may have the shape of a preferably quadrilateral tube which is formed by means of the base wall 3*a*, the cover wall 3*c* and the side walls 3*b*. With the present configuration, the width b of the carrier rail 3 is greater than its depth t in a direction transverse to the plane E. In such case, the sidewalls 3*b* form narrow sides and the cover wall 3*c* forms a broad side. In the cover wall 3*c* there is present, opposite to each first plug-in connection part 13*a*, a common plug recess 21 for the second plug-in connection part 13*b*. Alternatively, there may be provided a plurality of plug recesses (not shown) for the plug shafts 17. In both cases the second plug-in connection part 13*b* is contactable with the first plug-in connection part 13*a* through the cover wall 3*c* and into the hollow space of the carrier rail 3.

The plug recess 21 (FIG. 2) or a plurality of above-described smaller plug recesses in the hole pattern of the plug shafts 17, (FIG. 4) can be formed for example by stamping the cover wall 3*c* at the particular locations concerned so that a plug-in connection part 13*b* is provided at each location. The respective arrangement position is indicated by means of the position of the plug-in connection part 13*b* on the light body 5.

The width b1 and the depth t1 of the slide 19 are so adapted to the associated internal dimensions of the carrier rail 3 that the slide 19 is longitudinally displaceable in the carrier rail 3 with slight play for movement, whereby the base rail 3 forms a guide for the slide 19. In order to facilitate the introduction of the slide 19 into the carrier rail 3 the end face edges of the slide 19 are interrupted by edge breaks 22, 23 or oblique surfaces or roundings.

The light body 5 may be box-like and U-shaped in cross-section, as is shown in FIG. 2, or tube-like as is shown in FIG. 3. In both cases the light body 5 has a base wall 5*a* and side walls 5*b* extending therefrom. In the case where the light body is of a tube-shape, the side walls 5*b* are connected with one another by means of a cover wall 5*c*, whereas in the case where the light body is a U-shape, the side walls 5*b* are free web walls. As can be seen in FIG. 3, where the light body 5 is of tube shape, the recesses 21 extend through the walls 3*c* and 5*c* are in each case common.

The quick-fastening connection 6 between the light body 5 and the carrier rail 3 preferably comprises a latching device 6*a* the latching effect of which can be manually overcome so that the light body 5 can be pressed into the latching device 6*a* upon its mounting. The light body 5 may be removed from the carrier rail 3 by applying a dismounting force which is larger than the latching force. The latching device 6*a* may be formed by means of latching webs 3*d* on the carrier rail 3 which project from the side walls 3*b*. These latching webs extend continuously in a longitudinal direction. In the latching position, the webs 3*d* engage behind latching edges 5*d* on the side walls 5*b*. These latching edges extend preferably continuously in the longitudinal direction of the side walls 5*d* and they are elastically bendable to the side by means of a pulling force. The introduction of the light body 5 into the latching device 6*a* can be simplified by means of oblique surfaces or roundings on the side walls 5*b* and/or on the latching webs 3*d*. With the configuration according to FIG. 2, with which the light body 5 is U-shaped, the latching webs 3*d* may also be elastically yielding upon pressing of the light body 5 to overcome the latching force.

Figure 7:
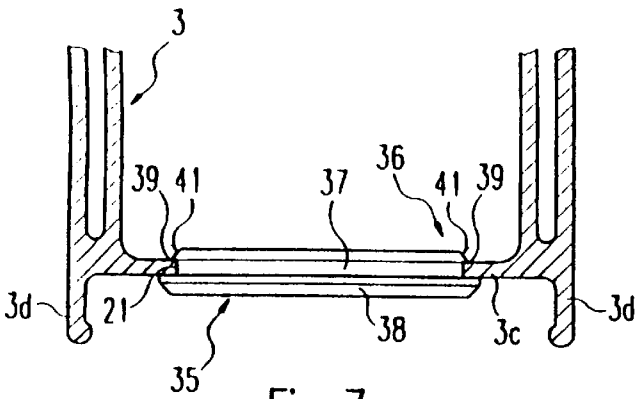
FIG. 7 is a fragmentary section view taken along line VII—VII of FIG. 2.

The plug-in connection part 13*b* (FIG. 4) is preferably a component associated with the light body 5, and is mounted onto the light body so that the light body 5 with the plug-in connection part 13*b* is moveable against the carrier rail 3 and into the recess 21 (FIG. 7). In this manner the plug-in connection part 13*b* connects with and contacts the plug-in connection part 13*a*; and the quick-fastening connection 6 serves to releasably secure the light body 5 to the carrier rail 3. The plug-in connection part 13*b* is arranged on the light body 5 preferably off-center in its longitudinal direction, for example in its end region.

Figure 5:
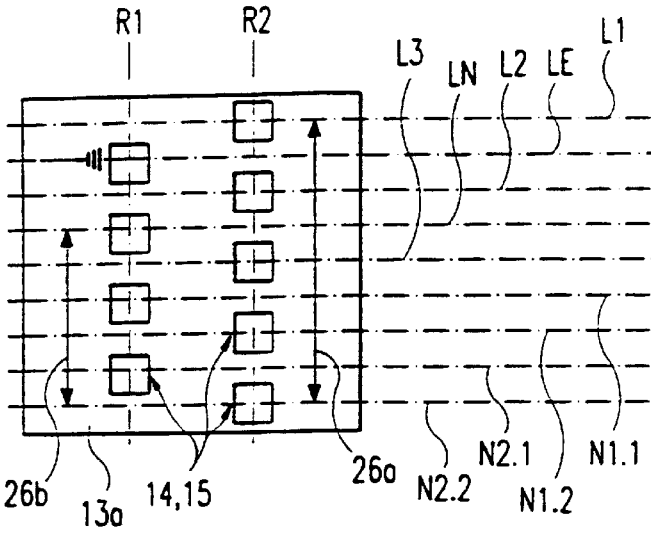
FIG. 5 is a schematic showing the wiring and contact arrangement of a first plug-in connection part of the lighting strip system of FIG. 1.

Since with a lighting strip 1 of a lighting strip system a plurality of lights or light bodies 5 are present it is advantageous for the purpose of avoiding an overloading to provide a plurality of phase conductors of the through-wiring element, e.g. three phase conductors. In this case the wires L1, L2, L3, (FIG. 2) to which lights are to be connected, are provided in a distributed number. Further, the through-wiring also has a ground or earthing conductor LE, a neutral conductor LN and two separate emergency current supply conductors. The first emergency current supply comprises conductors N1.1 and N1.2 and the second emergency supply comprises conductors N2.1 and N2.2. As can be seen in particular in FIGS. 4 to 6, the contact elements 15 and the associated counter-contact elements 16 are located in two rows R1 and R2, preferably extending at right angles to the wires 12. The contact positions for the wires L1, L2, L3, N1.1 and N2.2 are arranged in the row designated R1 and the contact positions for the wires LE, LN, N1.2 and N2.2 are arranged in the other row R2. In order on the one hand to be able to connect the lights A1, A2, A3, etc. (FIG. 1) to different phases and/or different emergency current supplies there is associated with the plug-in connection part 13*a* (not shown) or the plug-on connection part 13*b* in both rows R1, R2, a contact position selecting device which in the case of the present configuration is formed by means of a displacement guide 26*a*, 26*b* of which the displacement guide 26*a* extends over all contact positions of the row R2 and the displacement guide 26*b* extends, with the exception of the contact position for the conductor LE, over all other contact positions of the conductors LN to N2.2. Plug shafts 17 are formed on sliders 27 which are manually displaceable in each of the displacement guides 26*a* and 26*b* on the body of the plug-in connection part 13*b*. The lights $A_1$, $A_2$, $A_3$, etc. can thus be connected with three contact elements 16, namely a plug shaft 17, which is fixedly positioned for a ground or earth connection, and two sliders 27 which are selectively moveable to the normal current supply (phase) or emergency current supply.

The displacement guide 26*a*, 26*b* is in each case formed by a guide groove 28 (FIG. 4), in particular an undercut guide groove, extending transversely to the lighting strip 1 (FIG. 2), in which guide groove the at least one plug shaft 17 is displaceably guided. The sliders 27 of the plug shafts 17 are adapted to the cross-sectional form of the guide groove 28 to permit this displacement. For arresting the slide elements in their desired displacement positions, namely in the contact position with a desired electrical conductor, there is provided in each case a clamping or latching device 29, which can be released. The latching devices have a latching recess 29*a* and a latching nose 29*b* which engages into the recess. In the present exemplary embodiment the latching device is arranged on the slider 27, or vice versa.

It should be noted that because FIG. 4 is a perspective view and because the plane of the strip 12 containing the various wires L1, LE, L2, LN, L3, N1.2, N1.1, N2.2 and N2.1 is above that of the connection part 3*b*, the wires as shown appear to be located forwardly of their actual positions.

Figure 6:
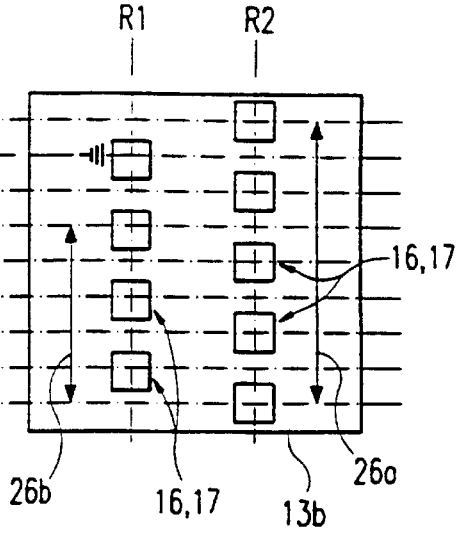
FIG. 6 is a schematic view showing the wiring and contact arrangement of a second plug-in connection part of the lighting strip section of FIG. 1.

With the present exemplary embodiment the counter-contact element 16 for the earth or ground conductor LE is unalterable. All other contact positions are selectable in the respective row R1 or R2. For this purpose at least three carriers for the counter-contact elements 16 are needed, in order, in a per se known manner, to select one of the phases or conductors L1, L2, L3 and thus to connect the lights A1, A2, A3, etc. to different phases and therewith to use the current supply of the phases as evenly as possible. The displacement tracks of the sliders 27 is illustrated in FIGS. 4 and 6 with double arrows.

Further, it is possible selectively to connect lights to the first and/or second emergency current supply. For this purpose there are needed two further counter-contact elements 16, which are positioned either at the contact positions for the conductors N1.1 and N1.2 or for the conductors N2.1. and N2.2. In order to make this possible, the carriers of the counter-contact elements 16, here the sliders 27, are exchangeable: that is, there are more than three sliders 27 present, so that for one emergency current supply two further sliders 27 can be mounted, which is effected by introducing such further sliders into the displacement guide 26*a*, 26*b*. Carriers or sliders 27 which are not needed can be taken out of the displacement guide and thus removed.

As shown in FIG. 4, an associated light may be connected to the mains current supply and to the emergency current supply by means of five contact elements 16, whereby three phases and two emergency current supplies are selectable.

Within the scope of the invention, there can be provided, instead of the at least one emergency current supply, additional control current lines which can be connected with associated contact elements 16 in a manner corresponding to that for the emergency current supply. In such case the number of contact positions or lines 1, 2 and 3 is correspondingly increased.

The above-described configuration of the lighting strip 1 improves on protection standard IP 65 so that the lighting strip 1 is dust-proof and protected against spray water. This protective standard is improved upon by means of the above-described configuration of the carrier rail 3 which, except for the plug recess 21 and the plug connection part 13*b* through the cover wall 3*c*, is continuously closed, this closing being effected by the longitudinally continuous latching elements, namely the latching webs 3*d*, which bear throughout on the side walls 5*b*. In the abutment region of the carrier rail 3 and of the light body 5, the protective standard is ensured by means of seals 24 (as shown in FIG. 1).

The mounting of the lighting strip sections 2 can be made either at the place of manufacture or at the site of installation. The carrier rails 3, the light body 5 and the through-wiring 12 with the plug-in connection parts 13*a* are in each case pre-fabricated to this extent and made available, for example, on a roll. The through-wiring 11 can thereby in each case be adapted to the length L of the light strip section 2, if applicable with an excess in the joint region as necessary for the electrical connection; or it may form a long supply reserve. Significant is that the spacings of the plug-in connection parts 13*a* with slides 19 pre-fabricated on the through-wiring 11 correspond to the spacings of the recesses 21 from one another which correspond to the lengths L, but are axially offset with regard to the joints 1*a*.

The through-wiring 11 with the at least one plug-in connection part 13*b* is mounted by introducing it longitudinally into the carrier rail 3 by pushing and/or pulling. Thereby, the longitudinal wiring 11 is located at a position such that the plug-in connection parts 13*a* or slides 19 are located in the longitudinal position of the recesses 21. This position can be set by means of a movement stop (not illustrated), which for example projects through the associated recess 21 into the path of movement of the slide 19. This fixing can be effected by means of stops placed into the recesses; or for example by frames which function as stops and which co-operate with counter-stops on the opposing plug-in connection part or slides. Thereby the thus formed arresting parts may also engage into holes in the plug-in connection parts or slides. Further, such an arresting can be effected by means of screws (not shown) penetrating through the cover wall 3*c* of the carrier rail 3 and engaging into the plug-in connection parts 13*a* or slides 19. In the transverse direction, the plug-in connection part 13*a* is positioned in the carrier rail 3 by means of the slide walls 19*b* and 19*d*, which form a transverse positioning device 31. After such introduction, longitudinal positioning of the slide 19 can be effected according to the available plug-in connection part or parts 13*b*, which by means of their form-fitting engagement with the associated plug-in connection part 13*a* form a longitudinal positioning device 32 (FIG. 1).

The through-wiring 11 with the plug-in connection part or parts 13*a* may be disconnected in a reverse manner, namely by longitudinally pulling it out from the carrier rail 3.

In each of the above-described exemplary embodiments, it is advantageous, for the covering or sealing of the hollow space in the carrier rail 3, to cover over, or to seal with a closure part, those recesses 21 which are not occupied with a plug-in connection part 13*b*, 13*b*1, 13*b*2. For this purpose there can be provided in each case a closure plate 35, for example in the configuration and arrangement in accordance with FIG. 7, which covers or seals the associated recess 21. With the exemplary embodiment according to FIG. 7, the closure plate 35 is releasably connected to the cover wall 3*c*, preferably by means of a latching device 36. The closure plate 35 may have an insertion part 37 which is insertable into the recess 21. The insertion part 37 may, on one broad side thereof, have latching clamps or may otherwise be latchable therein with the latching device 36. Thereby, the closure plate 35 may have a flange 38 which engages over the outer recess edge of the recess 21. This not only secures the position of the closure plate 35 but it can also act in a covering and sealing manner. The latching device 36 may have a plurality of latching noses arranged distributed around its periphery, or it may have a continuous latching edge 39, which, in each case, engage behind the inner edge of the recess 21. This engagement behind need only be slight. The material of the closure plate 35, at least in the region of the latching edge 39, is such that the closure plate 35 can be pressed and latched into the recess 21 by means of rounded or chamfered introduction surfaces 41, and can drawn out of the recess 21 by means of a pressing out, for example with the aid of a screw driver engaging beneath the flange 38, with a slight application of force. The closure plate 35 is preferably of plastics having an elasticity as described above.

It is further advantageous to provide recesses 21 for all possible different positions of the plug-in connection parts 13*b* or 13*b*1, 13*b*2, so that in this respect the carrier rail 3 is suitable for all positions of the plug-in connection parts.

What is claimed is:

1. Electrical connection device for contacting conductor wires of a strip-type conductor element extending in a given direction in said connection device with conductor wires of an electrical consuming unit, said connection device comprising:

a coupling part and a counter-coupling part configured to be plugged together, each of said parts having plural contact elements, the plural contact elements of one of said coupling part and said counter-coupling part being connected to an associated conductor wire and the plural contact elements of the other of said coupling part and said counter-coupling part being connected to the conductor wires of said electrical consuming unit, said contact elements being arranged such that upon plugging together of said parts, said contact elements make current connections between selected ones of said conductor wires of said strip-type conductor element with said conductor wires of said electrical consuming unit, the contact elements of each of said coupling and said counter-coupling parts being arranged in a first row and in a second row, each of said rows extending in a direction transverse to said given direction;

a first contact position selection device in at least one of said coupling part and said counter-coupling part and associated with said first row, said first contact position selection device being mounted to displace at least one contact element arranged in said first row between at least two contact positions corresponding to positions of contact elements of the other of said coupling part and said counter-coupling part along said first row; and a second contact position selection device in said at least one of said coupling part and said counter-coupling part and associated with said second row, said second contact position selection device being mounted to displace at least one of the contact elements arranged in said second row to the positions of said contact elements of said coupling part and said counter-coupling part along said second row, each of said first and second contact position selection devices comprising first and second displacement guides on said at least one coupling part and said counter-coupling part, and sliders configured to slide along said displacement guides, said sliders each carrying an associated one of said contact elements.

2. Electrical connection device according to claim 1, wherein:

a ground contact is mounted non-displaceably in one row of said first and second rows.

3. Electrical connection device according to claim 2, wherein:

a displacement path of said first contact position selection device along said one row includes said ground contact and extends over all other contact positions present in said one row.

4. Electrical connection device according to claim 1, wherein:

a displacement path of said second contact position selection device along said second row does not contain a ground contact and extends over all contact positions.

5. Electrical connection device according to claim 1, wherein:

said slide includes a latching device for latching said slide at said contact positions.

6. Electrical connection device according to claim 5, wherein:

said latching device is configured to become unlatched by the application of manual force thereto.

7. Electrical connection device according to claim 1, wherein:

said device includes at least five contact positions.

8. Electrical connection device according to claim 1, wherein:

said device includes nine contact positions.

9. Electrical connection device according to claim 1, wherein:

said device includes contact elements movable to contact positions for connection to one or two emergency current supplies and at least one control current supply.

10. Electrical connection device according to claim 1, wherein:

said device is provided with at least one control current supply.

11. Electrical connection device according to claim 1, wherein:

said device is provided with at least one emergency current supply and at least one control current supply.

* * * * *